United States Patent [19]

Hayashi et al.

[11] 4,451,042

[45] May 29, 1984

[54] GOLF CLUB HEAD OF CARBON FIBER REINFORCED PLASTIC

[75] Inventors: Keijiro Hayashi, Takatsuki; Toshimi Awano, Ohogaki; Masayuki Yoshikawa; Kouzou Yazawa, both of Gifu; Takashi Ito, Ohogaki, all of Japan

[73] Assignee: Mizuno Corporation, Osaka, Japan

[21] Appl. No.: 482,726

[22] Filed: Apr. 7, 1983

[30] Foreign Application Priority Data

Apr. 7, 1982 [JP] Japan ..... 57-58630
Apr. 7, 1982 [JP] Japan ..... 57-58629

[51] Int. Cl.[3] ..... A63B 53/06
[52] U.S. Cl. ..... 273/171; 273/167 H; 273/DIG. 8
[58] Field of Search ..... 273/167 H, 169, 171, 273/172, 167 A, 167 F, 80.3, 80.2

[56] References Cited

U.S. PATENT DOCUMENTS

| | | | |
|---|---|---|---|
| 1,515,390 | 11/1924 | Hubbard | 273/169 X |
| 1,638,916 | 8/1927 | Butchart | 273/169 |
| 3,266,805 | 8/1966 | Bulla | 273/169 |
| 3,692,306 | 9/1972 | Glover | 273/172 X |
| 3,843,122 | 10/1974 | Florian | 273/169 X |
| 4,076,254 | 2/1978 | Nygren | 273/171 |

FOREIGN PATENT DOCUMENTS

| | | | |
|---|---|---|---|
| 1201648 | 8/1974 | United Kingdom | 273/167 R |

*Primary Examiner*—George J. Marlo
*Attorney, Agent, or Firm*—Fleit, Jacobson, Cohn & Price

[57] ABSTRACT

A golf club head comprises a shell of carbon fiber reinforced plastic having a core embedded in the shell, the side and bottom of the shell are covered with a metal sole member including its integral side and sole portions, the core is positioned and retained in said shell by inserting a projection or projections on the sole member into the core and a pocket is provided in the sole member for containing weights to be used for weight adjustment of the head or balance adjustment.

8 Claims, 11 Drawing Figures

GOLF CLUB HEAD OF CARBON FIBER REINFORCED PLASTIC

The present invention relates to a golf club head made of carbon fiber reinforced plastic.

In general, natural material such as Japanese persimmon has been used for golf club heads, particularly wood heads. However, the use of the natural material is disadvantageous in that lots of time and labor are required to shape a piece of persimmon into a golf club head and that the yield rate is low. There is also been a difficulty in obtaining persimmon trees because of their shortage. Such being the situation, there has been known a head made of glass fiber reinforced plastic (hereinafter referred to as GFRP) which is produced by stiffening glass fiber with polyester resin, as described in Japanese Utility Model Publication No. 35-15505. In the head made of GFRP, however, the high specific gravity of glass fiber results in an increase in the head weight. In order to reduce the head weight, a polyurethane core must have been embedded in GFRP of the head. The conventional method has disadvantages in that the core cannot be properly retained in a mold so that the core may be displaced to an undesired position due to a pressure applied through GFRP to the core and the fluidity of GFRP during its molding to be exposed to the head surface upon completion of molding and this results in a weakened portion of GFRP shell surrounding the core and having a non-uniform thickness throughout the head. An attempt has been made to reinforce the neck portion of the head by disposing fibers longitudinally and spirally therein but this process is most time-consuming, and besides, if the glass fibers of the longitudinal and spiral orientations were to have a failure in their rate, the neck portion of the head would not provide enough strength to resist bending, compressive or tensile stress caused by impact on the head at the time of hitting the ball. That is, in case the rate of longitudinally disposed fibers relative to spirally disposed fibers is high, the neck portion has higher resistance against bending force but it is liable to be broken because of having lower resistance to torsional force. On the contrary, if the rate of spirally disposed fibers is higher than that of longitudinally disposed fibers, the neck portion has higher resistance against torsional force but lengthwise cracks are produced in the neck portion since it becomes weaker against bending force.

Japanese Utility Model Laid-Open Disclosure No. 50-9074 discloses a golf club head of carbon fiber reinforced plastic which has a ligher weight than the head made of GFRP because of the low specific gravity. Since the carbon fibers are large in diameter, the short fibers are not liable to be impregnated and mixed with synthetic resin to become bulky cakes which may disturb the molding operation. A club head which if formed from such a mixture by means of a mold, is insufficient in its strength since the rate of the carbon fiber in the mixture is limited to about 30%. As particularly in the neck portion of the head, its sufficient strength is not expected unless the rate of fibers in the mixture exceeds 60%, the neck portion is liable to be broken by impact at the time of hitting the ball. Further, the carbon fiber reinforced plastic containing the carbon fibers of about 30% and synthetic resin of about 70% results in reduction in the wear-resistance of the sole portion of the golf club head so that the sole portion is easily worn.

On the other hand, the club head formed from only the carbon fiber reinforced plastic causes the deflection of the head and irregular trajectory of the ball since the inertia moment of the head during hitting of the ball is reduced due to an improper center of gravity and unbalance of the head weight.

In the case of the fiber reinforced plastic head having its lighter weight, a weight adjustment of the head must be made by drilling the head and inserting weights into the drilled hole. Because of a difficulty in working or machining, however, the head may have cracks occured therein as well as a worse appearance.

A main object of the present invention is to provide a golf club head of carbon fiber reinforced plastic having a core properly embedded therein and a metal sole member which is fixedly secured to the shell without any mechanical screws arranged to cover the side and the bottom of the head, thereby preventing it from wearing off.

Another object of the invention is to provide a golf club head wherein the provision is provided in the metal sole member for facilitating a weight adjustment or balance adjustment for improved trajectory of the ball.

According to the invention, there is provided a golf club head comprising a shell of carbon fiber reinforced plastic comprising carbon short fibers impregnated with synthetic resin, a core embedded in the shell to reduce the head weight, a metal sole member including integral side and sole portions so arranged as to cover the side and the bottom of said shell, respectively, projections on the metal sole member inserted into the core to position and retain the core in the shell, and pocket means in the metal sole member for containing weights to achieve the weight adjustment of the head or balance adjustment.

These and other objects and advantages of the invention will become more apparent from the following description of embodiments of the invention made, by way of example, with reference to the accompanying drawings in which.

Figure 1:
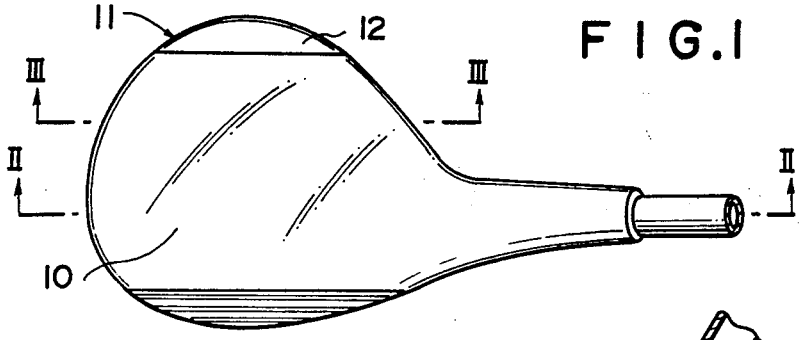
FIG. 1 is a top plan view of a golf club head according to the invention.
Figure 4:
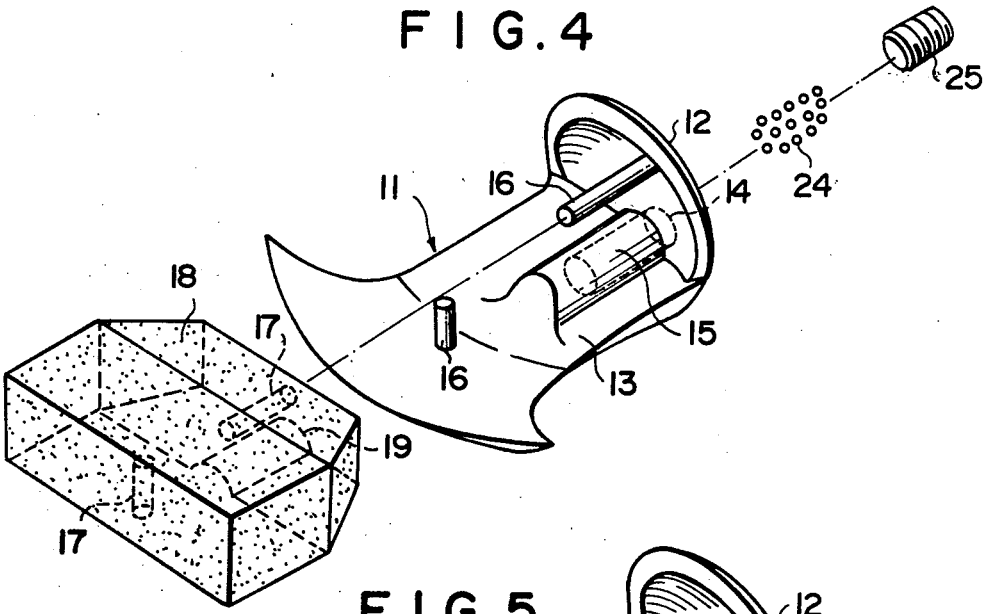
FIG. 4 is a perspective view of a metal sole member and a core forming a parts of the golf club head according to the invention.

Referring to FIG. 1 of the drawings, there is shown a golf club head 10 of carbon fiber reinforced plastic formed in accordance with the present invention. A metal sole member 11 includes a side portion 12 and a sole portion 13 formed integrally with each other as shown in FIG. 4. The sole member 11 is provided with a pocket 14 formed in a rising portion 15 on the sole portion 13 and opening laterally through the side portion 12. The sole member 11 is also provided with projections 16 and 16 in the form of pins extending inwardly and upwardly of the side and sole portions 12 and 13, respectively, which are inserted into holes 17 and 17 formed in a core 18 of foamed polyurethane to position and retain the core 18 on the sole member 11. The core 18 is provided on its bottom with a recess 19 which is seated on the top of the rising portion 15.

Figure 2:
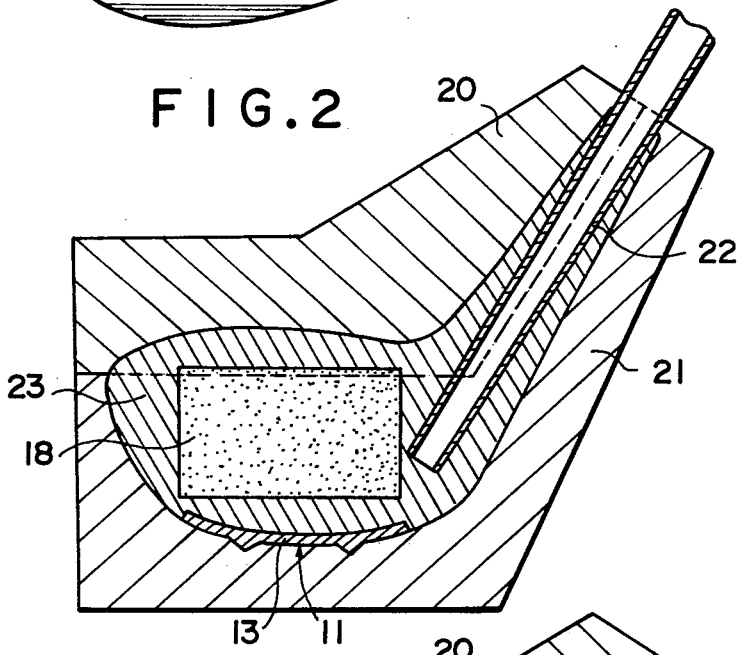
FIG. 2 is a cross-sectional view of a mold showing the molding of the golf club head according to the invention, and taken along a line corresponding to line II—II in FIG. 1.
Figure 3:
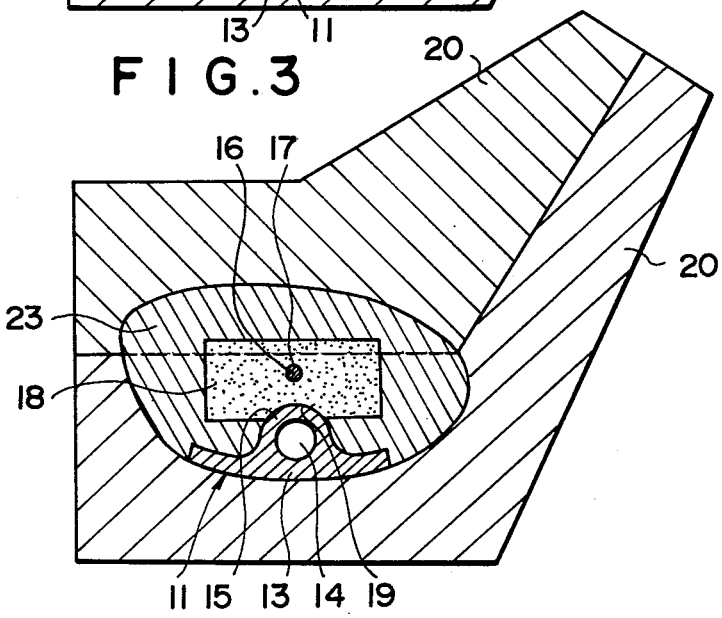
FIG. 3 is a view similar to FIG. 2, but taken along a line corresponding to line III—III in FIG. 1.

As can be seen in FIGS. 2 and 3, a mold includes its upper and lower mold halves 20 and 21 and the sole member 11 with the core 18 positioned thereon is positioned in the lower mold half 21 which is then filled with carbon fiber reinforced plastic comprising short carbon fibers impregnated with synthetic resin while positioning a mandrel 22 in a position where the neck portion of the club head is formed. It should be noted that the carbon fiber reinforced plastic is deposited around the core 18 and the mandrel 22. The upper mold half 20 is then placed on the lower mold half 21 so that the carbon fiber reinforced plastic is confined in a cavity defined between the upper and lower mold halves 20 and 21 to form a shell 23 of the golf club head 1 having the core 18 embedded therein. The mold is heated under pressure to mold the head.

The golf club head thus produced comprises the shell of carbon fiber reinforced plastic having the core 18 embedded therein and the metal sole as shown in FIG. 4.

The core 18 is securely fixed in the center portion of the head 10 by inserting the projections 16 into the core 18. This prevents the core 18 from displacing in the mold due to the molding pressure and fluidity of the carbon fiber reinforced plastic during molding operation. Thus, the shell of the head has a predetermined thickness and strength throughout the head.

Figure 5:
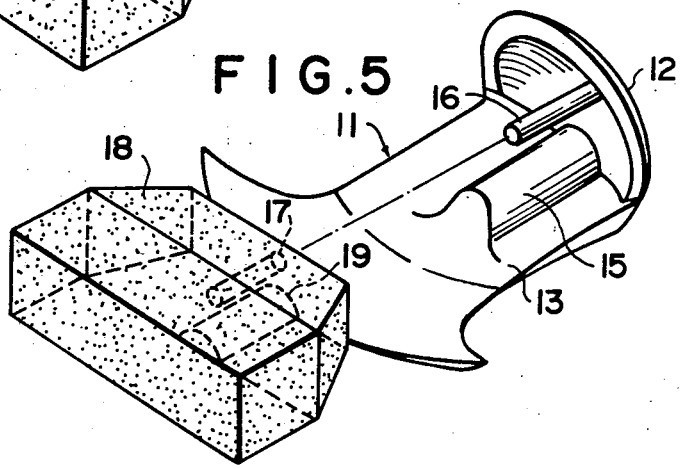
FIG. 5 is a view similar to FIG. 4 but showing another embodiment of the metal sole member.
Figure 6:
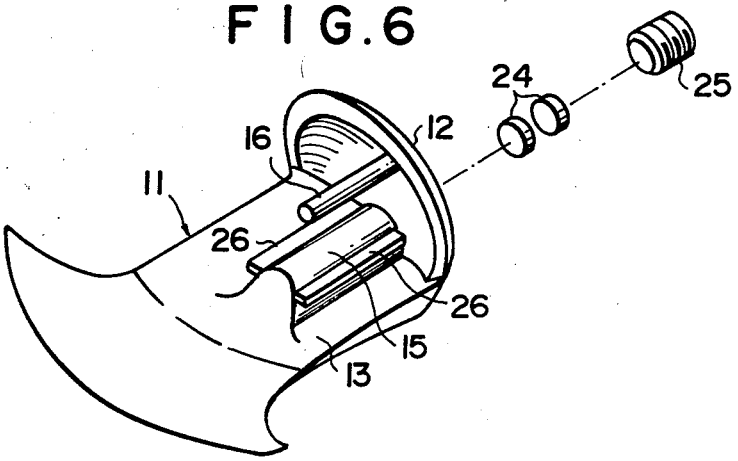
FIGS. 6, 7 and 8 are perspective view of various embodiments of the metal sole member.
Figure 7:
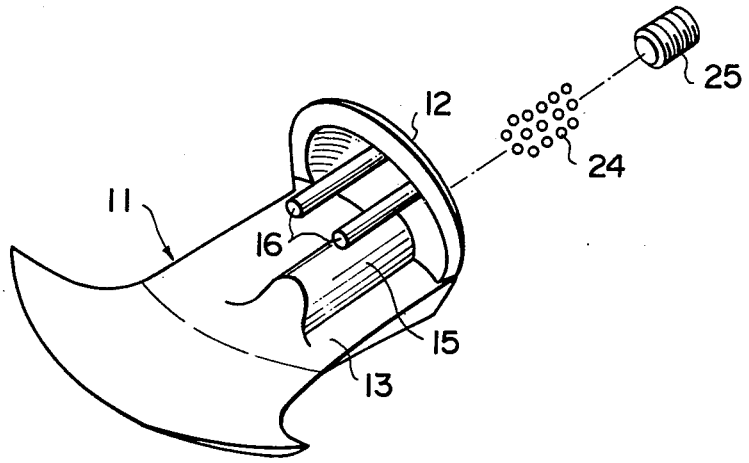
Figure 8:
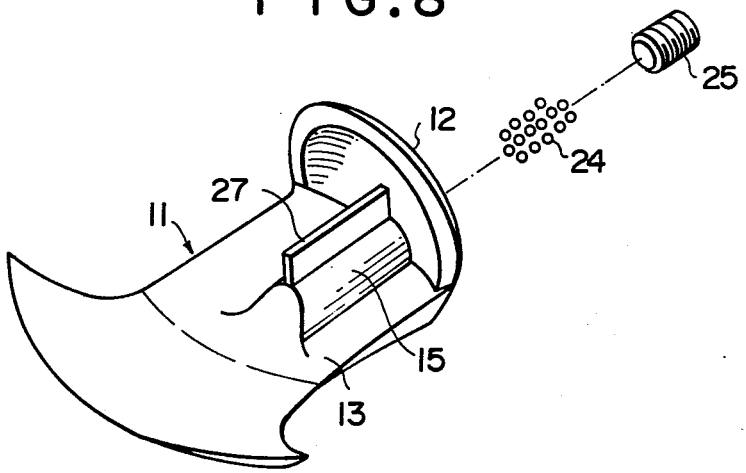

FIG. 5 shows an embodiment of the metal sole member 11 having a single projection 16 extending member 11 including the integral side and sole portions 12 and 13. The weight adjustment of the head 10 or swing balance adjustment after the head 10 has been attached to a shaft (not shown), can be achieved by selectively inserting weights 24 in the form of balls into the pocket 14 and closing it with a threaded plug 25 threadedly received in the opening of the pocket 14 inwardly of the side portion 12 thereof. The metal sole member 11 illustrated in FIG. 6 is similar to that illustrated in FIG. 5 except that projections 26 in the form of fins are horizontally formed on the rising portion 15 on its opposite sides to support the core 18. FIG. 7 shows a further embodiment of the metal sole member 11 having two parallel projections 16 extending inwardly of the side portion 12 of the sole member 11 to horizontally support the core 18 when the projections 16 are inserted into the core 18. A still further embodiment of the metal sole member 11 illustrated in FIG. 8 is provided with a single projection 27 in the form of a fin extending upwardly of the rising portion 15 at its top. The core 18 may be formed at its bottom with a groove in which the projection 27 is received to horizontally support the core.

Figure 9:
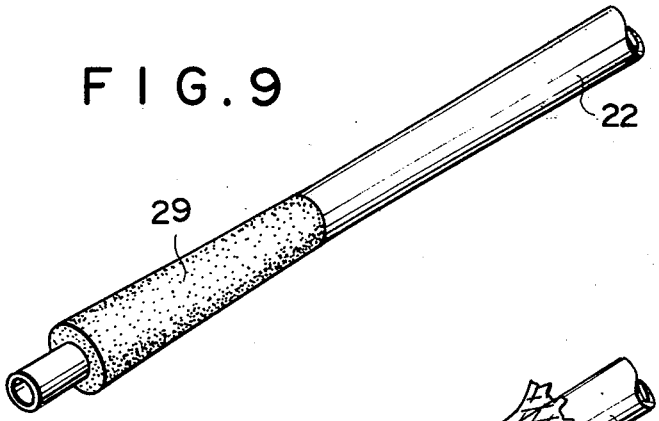
FIG. 9 is a perspective view of a mandrel having a tapered neck core fitted thereover.
Figure 10:
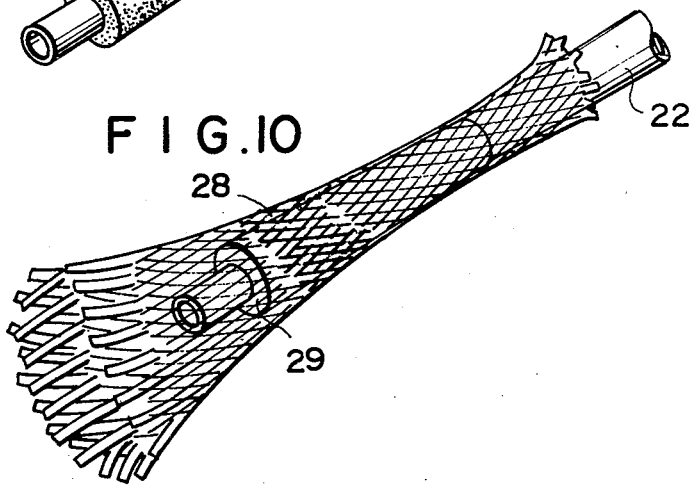
FIG. 10 is a perspective view of a fabric of carbon fibers surrounding the neck core on the mandrel.
Figure 11:
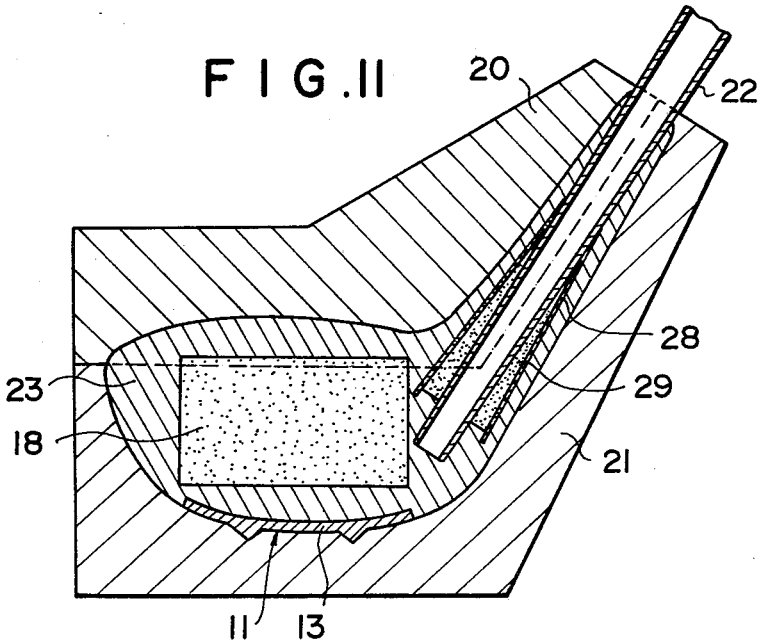
FIG. 11 is a view similar to FIG. 2 but showing the use of the mandrel with the neck core fitted thereover as shown in FIG. 9.

The neck portion of the golf club head may be provided with a reinforcement 28 of a synthetic resin impregnated carbon fiber fabric of a cylindrical shape surrounding an upwardly converging neck core 29 of foamed polyurethane and embedded in the neck portion of the golf club head. This can be achieved by the employing the mandrel 22 having the neck core 29 fitted thereover and covered with the reinforcement 28 of the synthetic resin impregnated carbon fiber fabric as shown in FIGS. 9 and 10 and positioning the mandrel 22 in the neck portion of the mold as shown in FIG. 11. The use of the neck core 29 makes it possible to decrease the weight of the neck portion of the head. Enlargement of the reinforcement 28 of the synthetic resin impregnated carbon fiber fabric along the shape of the neck core 29 results in the neck portion having an enough uniform strength along the length thereof to resist the bending and torsional forces imposed on the neck portion of the head.

Preferably, the carbon fiber reinforced plastic forming the shell of the golf club head contains the short carbon fibers of more than 60% to provide a high strength of the golf club head.

We claim:

1. A golf club head comprising a shell of carbon fiber reinforced plastic, a core embedded in the center portion of said shell to reduce the head weight, a metal sole member including integral side and sole portions so arranged as to cover the side and the bottom of said shell, respectively, projections on said metal sole member inserted into said core to position and retain it in said shell, and pocket means in said metal sole member for containing weights to be used for adjustment of the head or balance adjustment.

2. A golf club head as claimed in claim 1 wherein said shell has an enforcement of synthetic resin impregnated carbon fiber fabric embedded in the neck portion thereof.

3. A golf club head as claimed in claim 2 wherein a tapered neck core with said reinforcement disposed therearound, in embedded in the neck portion of the head.

4. A golf club head as claimed in claim 1 wherein said projections are in the form of pins extending inwardly of the side portion of said metal sole member.

5. A golf club head as claimed in claim 1 wherein said projections are in the form of pins extending inwardly and upwardly of said side and sole portions of said sole member, respectively.

6. A golf club head as claimed in claim 1 wherein said projections are in the form of fins extending horizontally of said sole portion of said sole member adjacent said pocket.

7. A golf club head as claimed in claim 1 wherein said sole portion of said sole member is provided with a single projection in the form of a fin extending upwardly thereof adjacent said pocket.

8. A golf club head as claimed in claim 1 wherein said pocket means includes a threaded plug threadedly received in an opening thereof to confine said weights in said pocket.

* * * * *